US005598880A

United States Patent [19]

Cross

[11] Patent Number: 5,598,880

[45] Date of Patent: Feb. 4, 1997

[54] TOP TREATMENT FOR BLINDS AND PACKAGING THEREFOR

[75] Inventor: David M. Cross, Westport, Conn.

[73] Assignee: Burlington Industries, Inc., Greensboro, N.C.

[21] Appl. No.: 460,597

[22] Filed: Jun. 2, 1995

[51] Int. Cl.[6] ..... E06B 9/00

[52] U.S. Cl. ..... 160/38; 160/348; 160/900

[58] Field of Search ..... 160/38, 39, 19, 160/348, 168.1 V, 173 V, 178.1 V, 34, 84.01, 405, 900

[56] References Cited

U.S. PATENT DOCUMENTS

| | | | |
|---|---|---|---|
| D. 345,098 | 3/1994 | Ohanesian . | |
| 2,159,734 | 5/1939 | French | 160/348 X |
| 3,196,511 | 7/1965 | Kintner | 160/348 |
| 3,774,666 | 11/1973 | Bunger | 160/348 |
| 3,791,436 | 2/1974 | Weckbrodt | 160/348 |
| 3,996,987 | 12/1976 | Rodriguez | 160/38 X |
| 4,180,117 | 12/1979 | Greer . | |
| 4,214,622 | 7/1980 | Debs . | |
| 4,262,728 | 4/1981 | Debs . | |
| 4,411,401 | 10/1983 | Anderson . | |
| 4,425,955 | 1/1984 | Kaucic . | |
| 4,425,956 | 1/1984 | Terlecke . | |
| 4,651,795 | 3/1987 | Valle et al. . | |
| 4,662,421 | 5/1987 | Basmadji et al. . | |
| 4,662,422 | 5/1987 | Anderson . | |
| 4,793,396 | 12/1988 | Anderson et al. . | |
| 4,799,527 | 1/1989 | Villoch et al. . | |
| 4,802,522 | 2/1989 | Anderson . | |
| 4,840,216 | 6/1989 | John . | |
| 4,848,435 | 7/1989 | Helver . | |
| 4,928,743 | 5/1990 | Wojtysiak | 160/84.01 |
| 4,930,562 | 6/1990 | Goodman | 160/38 X |
| 4,955,419 | 9/1990 | Morris . | |
| 4,976,301 | 12/1990 | Easley et al. | 160/84.01 |
| 4,986,329 | 1/1991 | Kupchunos . | |
| 5,004,033 | 4/1991 | Stipkovitz . | |
| 5,012,850 | 5/1991 | Schrader . | |
| 5,029,365 | 7/1991 | McCabe . | |
| 5,042,548 | 8/1991 | Attal | 160/38 |
| 5,054,535 | 10/1991 | Rozon | 160/38 |

(List continued on next page.)

FOREIGN PATENT DOCUMENTS 2606068 5/1988 France .

OTHER PUBLICATIONS

"Window Show Generates Energy," Searles, Retailing Home Furnishings, vol. 57, p. 16.

"Levelor, Croscill Team Up; Firms to Make, Sell Fabric Window Coverings," Rothstein; HFD—The Weekly Home Furnishings Newspaper, vol. 59, p. 63.

"A Fashionable Fight; Window Treatments," Rothstein; HFD—The Weekly Home Furnishings Newspaper, vol. 59, p. 1.

"Western Window Coverings Show Bounteous Offerings, Span Gamut of Styles, Colors, Materials," Schwartz; HFD—The Weekly Home Furnishings Newspaper, vol. 64, p. 36.

"Drapery Hardware; Out of Hiding, into the Light (New Design Ideas)," Bermingham; HFD—The Weekly Home Furnishings Newspaper, vol. 65, p. 53.

*Primary Examiner*—David M. Purol

*Attorney, Agent, or Firm*—Nixon & Vanderhye

[57] ABSTRACT

The top treatment includes a fabric sleeve having a pleating tape sewn along a backside with sections of one of hooks and loops spaced one from the other along the pleating tape and forming a part of a Velcro™-type fastener. A header is secured to a headrail of a vertical blind and includes along an outer face an elongated strip of the other of the hooks and loops of the Velcro™-type fastener. The fabric sleeve has a drawstring to form a pleated valance which is applied to the header by engaging the hooks and loops one with the other. In another form, a groover valance receives short lengths of slats having tapes containing another of the hooks and loops of the fasteners. By inserting the slats along the groover valance, the fabric valance may be applied to the groover valance. The slats and fabric sleeve may be provided separately in small soft packages.

7 Claims, 4 Drawing Sheets

U.S. PATENT DOCUMENTS 5,074,348 12/1991 Phillips .
5,088,542 2/1992 Biba et al. .
5,133,399 7/1992 Hiller et al. .
5,152,331 10/1992 Barone .
5,158,632 10/1992 Colson et al. .
5,159,965 11/1992 Roy et al. .
5,179,990 1/1993 Marocco .
5,195,570 3/1993 Marocco .
5,230,375 7/1993 Linder .
5,238,044 8/1993 Gilley et al. .
5,259,687 11/1993 John ..... 160/38 X
5,313,998 5/1994 Colson et al. .
5,351,741 10/1994 Swopes .
5,361,821 11/1994 Barone .
5,377,740 1/1995 Gilley et al. .
5,392,833 2/1995 Ohanesian ..... 160/168.1 V X

TOP TREATMENT FOR BLINDS AND PACKAGING THEREFOR

TECHNICAL FIELD

The present invention relates to a decorative valance assembly forming part of a top treatment for blinds such as window blinds and vertical blinds, and particularly relates to a soft top treatment for vertical blinds which can be readily mixed and matched with aesthetic characteristics of blinds and room decor, such as color, fabric, patterns and texture, and which top treatment can be readily installed. The present invention also relates to packaging therefor.

BACKGROUND

Various types of valance assemblies for aesthetically covering the mechanical parts necessary for operation of draperies, blinds, including vertical blinds and the like covering door and window openings, have been proposed and utilized in the past. Such valance assemblies have taken the form of fabric-covered panels secured to the wall in overlying relation to the mechanical pads of the covering, such as tracks, headrails or the like, so that the mechanical parts are generally hidden from view. Where the fabric has simply been applied to stiff panels, the panels must be of considerable length, such as the full width of a sliding door, and, of course, supported from the adjacent wall. Panels of this type are cumbersome to fabricate, require almost custom fitting, and do not readily admit of a change in the fabric to effect, for example, a change in color or decorative pattern. From the manufacturer's standpoint, it is also difficult to include such decorative valance assemblies in the packaging for the blinds.

More modern blinds, such as venetian blinds, mini blinds or vertical blinds, have somewhat improved valance assemblies, solving some of the aforementioned problems. For example, U.S. Pat. No. 4,662,421 describes a valance assembly for a vertical blind having a groover valance carrying decorative material, such as a fabric, which is glued on a rigid backing material or held in place by edge flanges. The valance assembly itself is secured to the headrail mounting the blinds by clips. Here, again, however, the panels on which the fabric is to be mounted are provided in lengths typically exceeding the width of the blinds, rendering the packaging and installation of the valance assembly difficult. The difficulty in packaging, the cumbersome nature of elongated panels and the difficulty of installation affords little incentive to change the fabric of the valance assembly to afford a different color, texture or "look" which might otherwise be readily coordinated with other colors, fabrics, patterns or textures within the room or with the color or fabric of the blinds themselves.

DISCLOSURE OF THE INVENTION

According to the present invention, there is provided a novel and improved valance assembly having an improved appearance, which is readily and easily installed, and which may be inexpensively manufactured and readily and easily packaged for the consumer. A standard groover valance for a blind headrail is replaced with a mounting panel having fastening elements comprising one of hooks and loops of a Velcro™-type fastener along an outer face thereof. Packaged with the blind is a top treatment comprised of a pole sleeve configured fabric having a pleating tape sewn along a backside and to which pleating tape fastening elements of the other of the hooks and loops of the Velcro™-type fastener are applied preferably in spaced apart groupings. After the blind, including the headrail, has been installed in a conventional manner, the mounting panel is secured by clips to the headrail or to the wall. Drawstrings passing through the top treatment fabric are pulled to shirr down the fabric into a uniform and attractive, essentially pleated, top treatment. The shirring down causes the spaced apart sets of hooks or loops of the fasteners on the fabric to form a substantially continuous fastening element along the backside of the fabric. Thus, the installer applies the shirred fabric along the mounting panel by engaging the hooks and loops of the fastener with one another. It will be appreciated that the fabric is thus securely held in place, appears as a neat and essentially uniformly pleated fabric without interference with the operation of the blinds, and may be readily packaged with the blinds due to the foldable nature of the fabric.

In another aspect of the present invention, a standard groover valance may be used in conjunction with the pole sleeve configured fabric previously described. To accomplish this, a plurality of slats approximately 5" or 10" in length or a combination thereof are receivable in the standard groover valance. Each slat has along an outer exposed face fastening elements comprised of one of hooks and loops of a Velcro™-type fastener. The slats are inserted along the groover valance in succession, with the fastening elements extending substantially continuously along the outer faces of the slats. Thus, the fabric may be pleated as previously described and placed against the slats, with the hooks and loops engaging one another to retain the fabric along the valance. The slats are provided in short, discrete lengths to facilitate packaging thereof, together with the folded valance fabric in small soft bags or similar packages, rather than being provided in lengths comparable to the length of the standard blind rail. This enables a manufacturer to offer in relatively small packages a variety of attractive fabric valances in different colors and styles for mixing and matching selection with other blind treatments, as well as other room decors.

In a preferred embodiment according to the present invention, there is provided a valance assembly for use with blinds comprising an elongated valance mounting panel, a fastener including a plurality of one of hooks and loops carried by the mounting panel along an outer face thereof, a valance including an elongated strip of fabric having longitudinally spaced sets of a plurality of another of the hooks and loops of the fastener spaced one from the other along a backside of the fabric, and a drawstring disposed along the fabric for shirring the fabric into a substantially pleated configuration with the fastening members along the backside of the fabric, the shirred fabric being applied to the panel with the plurality of one of the hooks and loops engaging the sets of the plurality of another of the hooks and loops to secure the valance to the panel.

In a further preferred embodiment according to the present invention, there is provided a valance assembly for use with blinds comprising an elongated groover valance, a plurality of slats for insertion along the groover valance, each of the slats having a plurality of one of hooks and loops carried along an outer face thereof, a valance including an elongated strip of fabric having a plurality of another of the hooks and loops along a backside of the fabric, the fabric being applied to the slats along the groover valance with the plurality of one of the hooks and loops carried by the slats engaging the plurality of another of the hooks and loops to secure the fabric to the groover valance.

In a still further preferred embodiment according to the present invention, there is provided packaging for a top treatment for vertical blinds comprising an elongated strip of fabric for forming a valance, the fabric having longitudinally spaced sets of a plurality of one of hooks and loops spaced from one another along the backside of the fabric and a drawstring disposed therealong for shirring the fabric into a substantially pleated configuration with the sets of the plurality of one of the hooks and loops exposed along the backside thereof, the fabric being folded about multiple fold lines generally laterally of its length, a plurality of slats for insertion along a groover valance, each of the slats having a plurality of another of the hooks and loops along a face thereof for engagement with the set of the plurality of one of the hooks and loops, the slats being superposed one adjacent another, and an enclosure forming a package for receiving the folded fabric and the slats.

Accordingly, it is a primary object of the present invention to provide a novel and improved valance assembly and packaging therefor whereby different soft treatments can be readily and easily applied as valances over window or door coverings, such as blinds.

BEST MODE FOR CARRYING OUT THE INVENTION

Figure 1:
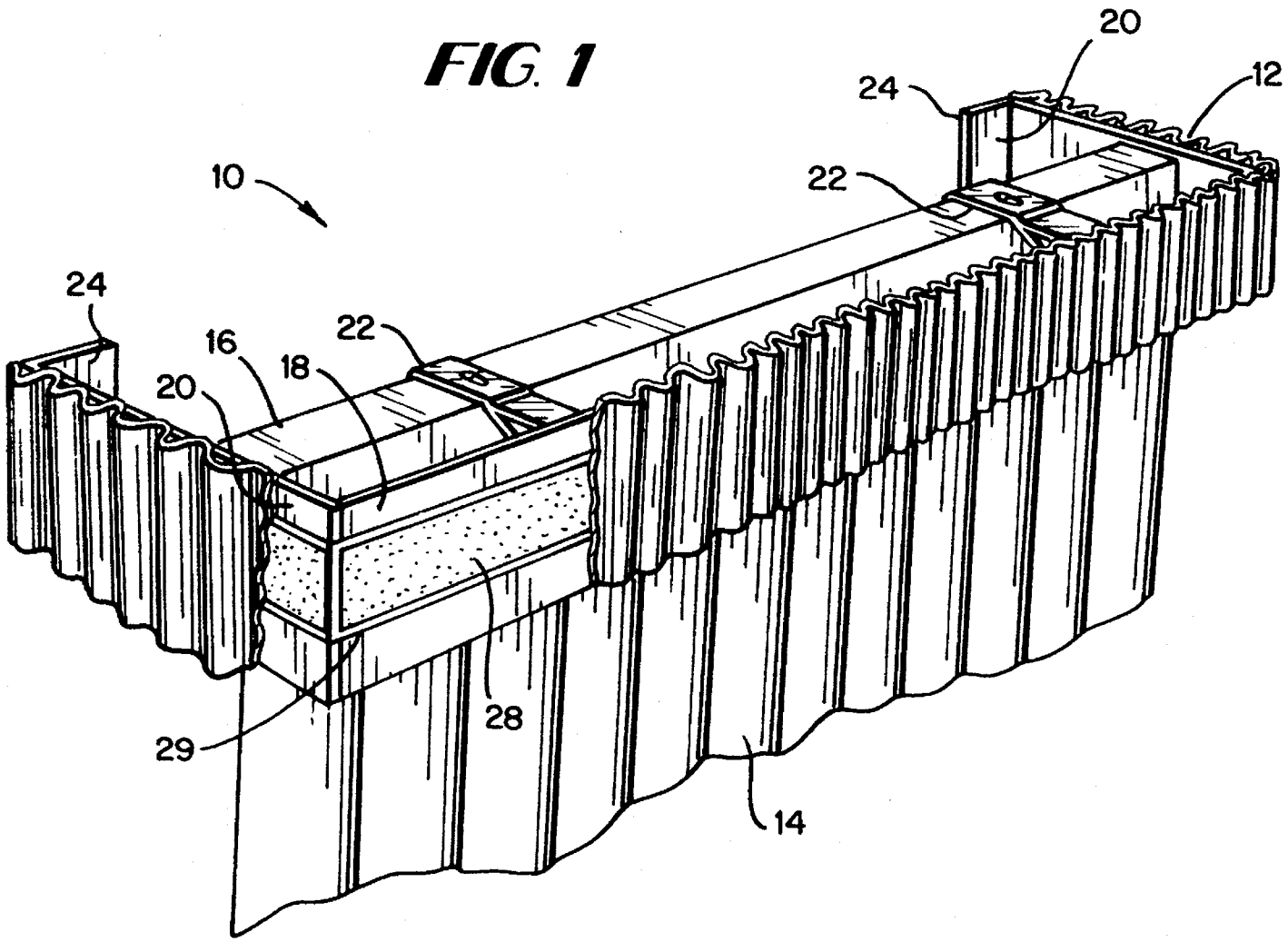
FIG. 1 is a perspective view of a valance illustrating in a preferred embodiment a soft top treatment for vertical blinds.

Referring now to the drawings, particularly to FIG. 1, there is illustrated a header, generally designated 10, for mounting a top treatment forming a valance 12 for vertical blinds 14. While the header 10 is specifically employed for mounting the vertical blinds 14, it will be appreciated that other types of blinds can be mounted or hung in combination with the valance 12 of the present invention. For example, horizontal blinds, mini blinds, or fabric draperies may be employed in connection with the present invention in lieu of other types of door and window coverings, such as the vertical blinds 14.

The header 10 includes a headrail 16 which is typically a channel-shaped elongated member having an opening along its underside and within which member is mounted a control cord and a plurality of vane carriers mounted for movement along the headrail 16 in response to movement of the control cord. The control cord and carriers are not illustrated, as these are conventional in construction. Suffice to say that the individual vanes of the vertical blinds 14 are connected to each carrier in a manner such that the vanes can be drawn to one side or the other, or both, and also rotated about vertical axes to alter the angle of the vanes relative to the window or door being covered by the vertical blinds. It will also be appreciated that the headrail 16 is secured to an adjacent supporting wall structure by mounting brackets, not shown, which support the headrail 16 at the desired elevation.

Attached to and carried by the headrails 16 are an elongated front panel 18 and return panels 20 at opposite ends of and extending at right angles to panel 18. The front panel 18 may be secured to the header 10 by mounting clips 22 extending between the panel 18 and the headrail 16. The front panel 18 and the return panels 20 may each comprise flat, planar sheet material such as a plastic material, having inturned flanges along the inside faces thereof for structural strength and to facilitate connection of corner clips, not shown, whereby the front panel 18 and the return panels 20 can be secured one to the other. A similar type clip 24 may be provided at each of the free ends of the return panels 20 for engagement against the supporting wall. If necessary, the clips 24 can be secured, for example, by screw fasteners, to the wall. An adhesive may also be applied to the faces of the return clips confronting the supporting wall to adhere the panels to the wall.

As readily seen in FIG. 1, fasteners are provided along the exposed outer surfaces of the front and return panels 18 and 20, respectively. The fasteners preferably comprise part of a hook and loop fastener arrangement, known generally as Velcro™ fasteners. Thus, for example, the outer faces of panels 18 and 20 can be provided with hooks 28 of the Velcro™-type fastener, although it will be appreciated that the loops of the Velcro™-type fasteners may be used along the panels 18 and 20 instead. The fasteners are applied in the form of a strip or tape 29 which may be adhesively secured along the outer faces of the panels 18 and 20.

Figure 2:
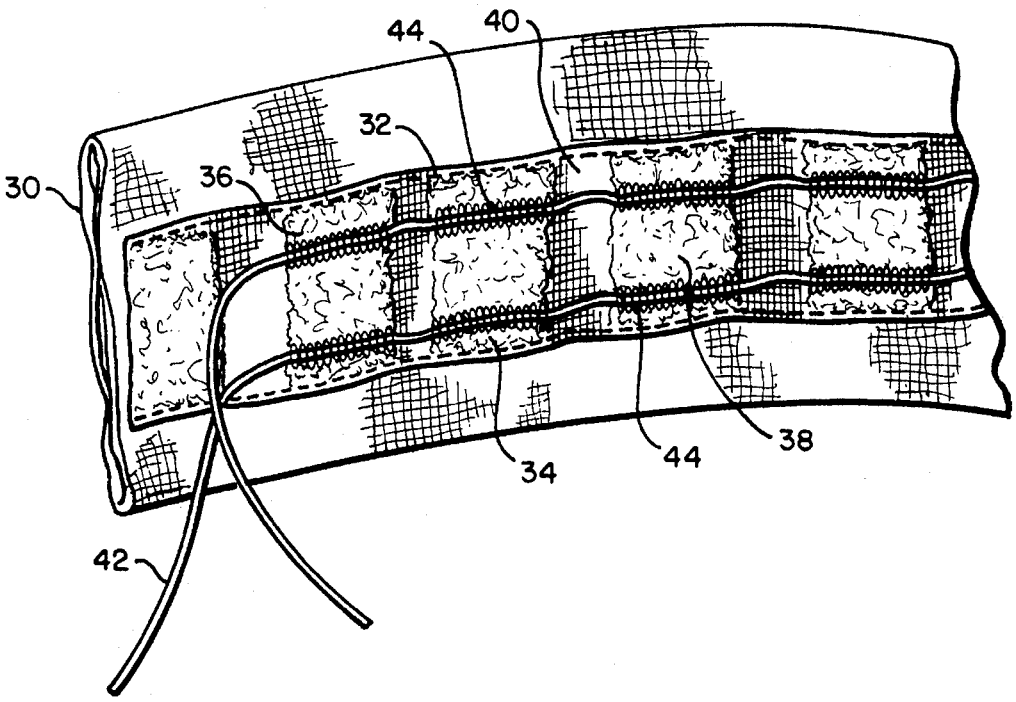
FIG. 2 is an enlarged fragmentary perspective view of the backside of the top treatment.
Figure 3:
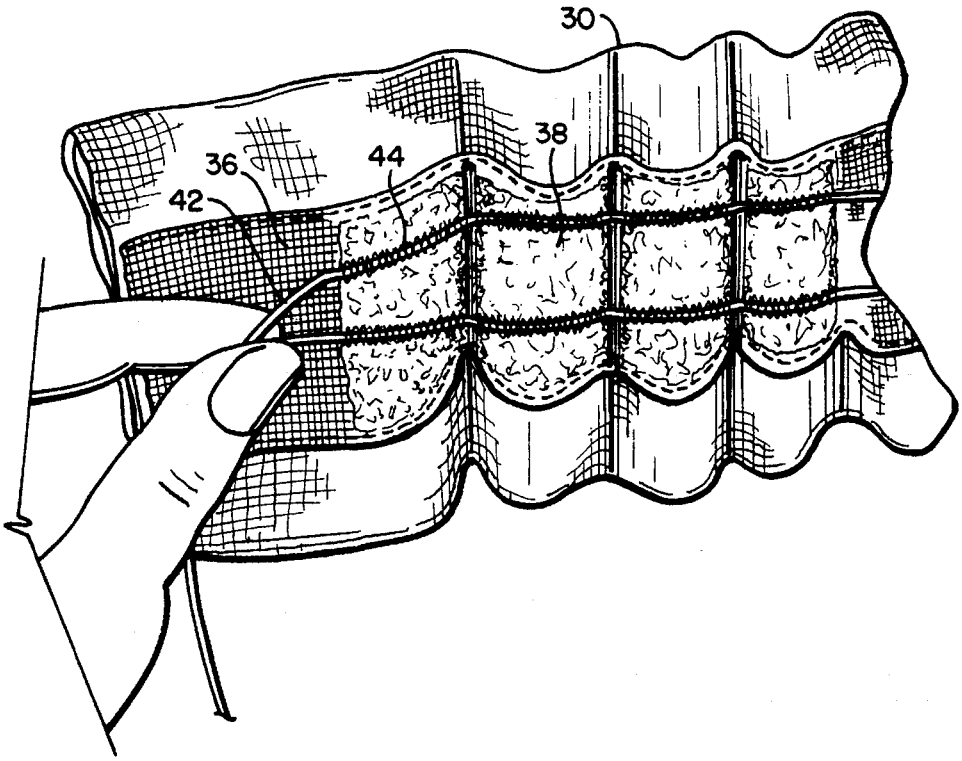
FIG. 3 is a view similar to FIG. 2 illustrating the top treatment in a shirred configuration.
Figure 4:
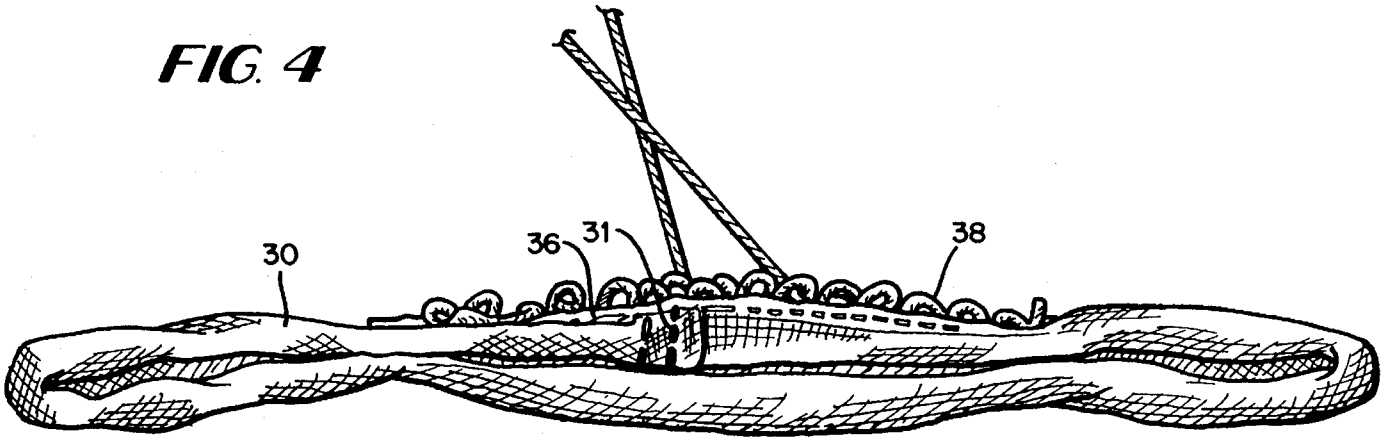
FIG. 4 is an end view of the top treatment illustrated in FIGS. 2 and 3.

Referring to FIGS. 2–4, the soft top treatment for the valance 12 is illustrated. Preferably, the soft top treatment 12 includes a sleeve 30 of a decorative fabric material. The sleeve 30 is centrally seamed along its backside as illustrated at 31 in FIG. 4. Secured to the backside of sleeve 30, preferably by stitch rows 32 and 34, is a pleating tape 36. Pleating tape 36 has longitudinally spaced sections of another part of the Velcro™-type fasteners. That is, where hooks 28 are supplied to the outer faces of panels 18 and 20, loops 38 of the Velcro™-type fasteners are supplied in sections along the backside of pleating tape 36. The areas between the sections of the loops 38 of the Velcro™-type fasteners are clear of any type of fastening material and thus the loops 38 alternate with clear sections 40 of the pleating tape 36 for the full length of the tape on the backside of the valance 12. A drawstring 42 slidably passes through channels 44 formed by stitching in the pleating tape 36 adjacent upper and lower sides of tape 36 and extending through the sections containing the loops 38. The portions of the drawstring 42 between the channels 44 and overlying the clear sections 40 of the pleating tape 36 are free of attachment to the pleating tape. With this arrangement, it will be appreciated that by drawing on the drawstring 42 as illustrated in FIG. 3, the soft top treatment 12 can be gathered or shirred to form a pleated soft treatment for the valance as illustrated in FIG. 1. Note that by drawing the fabric 12 together to form the pleats, the sections containing the loops 38 of the Velcro™-type fasteners are drawn together such that a substantially continuous line or strip of loops is formed along the backside of the valance 12 as best illustrated in FIG. 3.

To install the blinds with the soft top treatment or valance 12, the blinds are installed in a conventional manner by using mounting brackets, not shown, for securing the headrail 16 to an adjacent supporting wall whereby the headrail 16 and vertical vanes 14 in the preferred vertical blinds may be hung above the window or door being covered. The panels 18 and 20 are then applied to the headrail 16 using the mounting clips 22. Suitable screw or clip-type fasteners may be used to secure the valance panels 18 and 20 to the headrail 16. To apply the soft top treatment 12, the installer holds the drawstring 42 of the valance 12 to gather and shirr down the fabric to form a generally pleated appearance, as illustrated in FIG. 3 and as finally installed in FIG. 1. When the fabric has been shirred down, to a desired length the loops 38 of the Velcro™-type fastener lie substantially continuously along the backside of the valance 12. By pressing the valance 12 and particularly the loops 38 against the hooks 28 of the Velcro™-type fasteners carried by the panels 18 and 20, the shirred top treatment may be placed over and secured to the head or panel. The pleating tape 36 ensures that the valance appears neat and uniform along the length of the top treatment.

Figure 5:
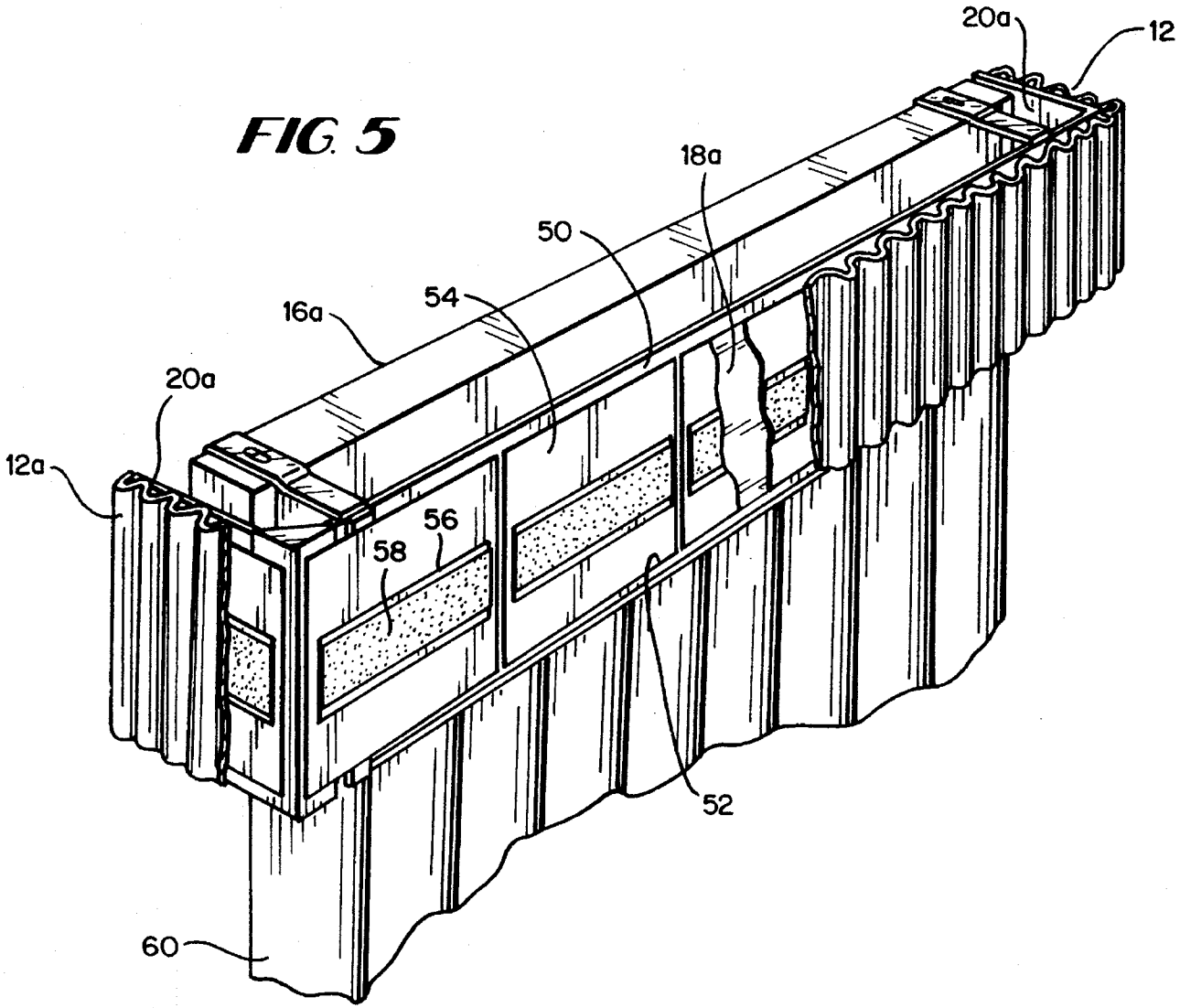
FIG. 5 is a view similar to FIG. 1 illustrating a further form of the present invention employing a groover valance.

In a further form of top treatment illustrated in FIG. 5 hereof, a similar type valance 12 is formed, as described previously in connection with the first embodiment of the present invention. In this form, however, the headrail **16*a* mounts a conventional groover valance. The groover valance essentially comprises front and return panels 18*a* and 20*a*, respectively, which have flanges 50 and 52 projecting forwardly along the upper and lower edges, respectively, of the panels 18*a* and 20*a*. The panels 18*a* and 20*a* are typically formed of a plastic material having outer surfaces curved in a generally outwardly convex configuration. Instead of disposing a fabric valance insert into the flanges 50 and 52 for overlying the panel 18*a* and 20*a*, as in a conventional groover valance, the present invention provides a plurality of slats 54 which are similarly curved as the panels 18*a* and 20*a*. The upper and lower edges of the slats 54 are receivable in the grooves formed by the flanges 50 and 52, respectively. Thus, a plurality of slats 54 may be disposed endwise along the panels 18*a* and 20*a*, with the slats 54 along the front panel 18*a*** lying next-adjacent one another in final assembly.

The outer faces of the slats 54 are provided with tapes 56 mounting the hooks 58 of Velcro™-type fasteners, although it will be appreciated that the tapes 56 may mount the loops of Velcro™-type fasteners provided the other of the loops and hooks are carried by the fabric. It will also be appreciated that the slats 54 may be inserted in the end returns **20*a* prior to mounting the groover valance on the headrail 16*a* or may be mounted afterwards by cupping the slats to insert their long edges into the grooves formed by flanges 50 and 52**.

To install the valance in this form of the invention, the slats 54 are preferably disposed endwise into the grooves along the upper and lower edges of the panel **18*a*. The end edges of the end slats 54 are received in end grooves formed by corner clips 60. To install the final slat along the front panel 18*a*, the slat may be cupped such that its upper and lower edges may be received in the upper and lower grooves of panel 18*a* formed by flanges 50 and 52 with the slat being then translated along panel 18*a* so that its end edge engages into a corner clip. Similarly, the slats may be inserted endwise along the returns 20*a* or cupped so that their edges may be received in the grooves of the groover valance returns 20*a*. Consequently, it will be appreciated that a substantially continuous strip of hooks of Velcro™-type fasteners is provided along the front panel 18*a* and the end returns 20*a*. With the groover valance installed on the headrail 16*a* using the mounting clips, the soft top treatment or valance 12 can then be applied to the groover valance slats by pressing the loops along the backside of the gathered and pleated valance 12 against the hooks of the slats 54**.

Figure 6:
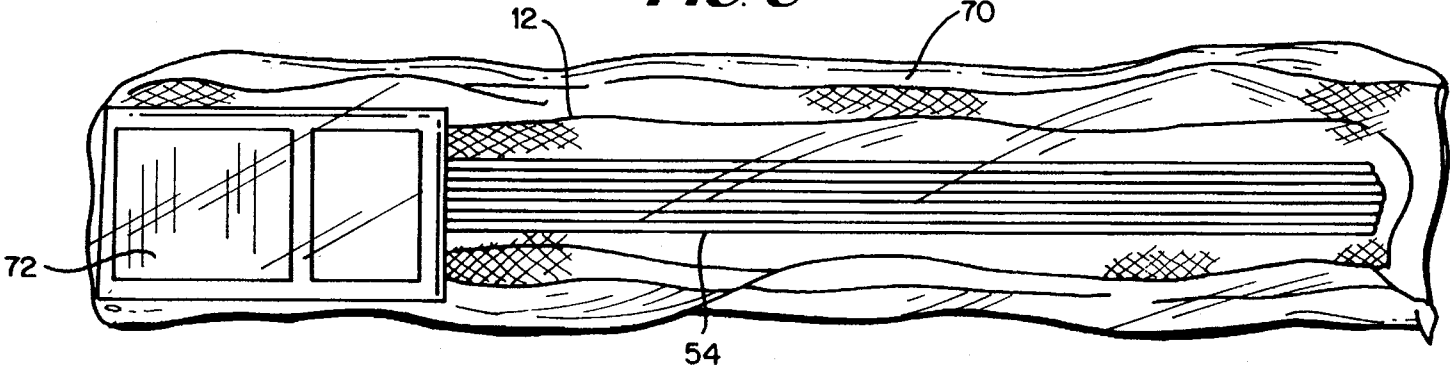
FIG. 6 is an enlarged elevational view of a package for containing the top treatment and slats for the groover valance of FIG. 5.

In the preferred embodiment of this invention, the slats 54 are provided in discrete lengths, for example, on the order of 5" or 10" or a combination thereof. This enables the slats to be packaged in small, preferably soft, containers or bags, for example, as illustrated in FIG. 6, together with the soft top treatment or valance 12. In this manner, a variety of attractive fabric valances in different colors, styles, patterns and fabrics for the consumer to mix and match with other elements of the blind, i.e., the fabric of the vertical blinds, or with the decor of the room, whereby different and selected aesthetic appearances may be provided. The shod slats 54 packaged with the valance enable the valance to be packaged separately from and to be installed in elongated groover valances without the necessity to package the valance fabric in the packaging used to contain the standard lengthy beadrail. Thus, the consumer can mix and match the colors, fabrics and styles of valances as desired, without necessarily using the valance fabric otherwise provided in the packaging containing the headrail and which may not provide the aesthetic appearance desired by the consumer.

Consequently, in FIG. 6, there is illustrated a package which, for example, may comprise an outer clear plastic flexible packaging material 70. Within the package, the fabric 12 with the pleated tape and drawstring may be folded. Additionally, in the package, the slats 54 may be provided in a stack, either centrally with the fabric folded about the slats, or along a side of the package 70. An end label 72 may be provided within the package to identify the color, style and type of fabric, as well as certain other characteristics, e.g., dimensions, manufacture and the like.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A valance assembly for use with blinds comprising;

an elongated groover valance;

a plurality of slats for insertion along the groover valance, each of said slats having a plurality of one of hooks and loops carried along an outer face thereof;

a valance including an elongated strip of fabric having a plurality of another of said hooks and loops along a backside of said fabric, said fabric being applied to said slats along said groover valance with said plurality of one of the hooks and loops carried by the slats engaging said plurality of said another of said hooks and loops carried by said fabric to secure the fabric to the groover valance.

2. A valance assembly according to claim 1 in combination with a vertical blind having a headrail and generally vertically extending vanes spaced from one another and dependent from said headrail, said groover valance and said fabric overlying said headrail, substantially hiding said headrail from view.

3. A valance assembly according to claim 1 including a return at each of the opposite ends of said groover valance, at least one of said slats being inserted into each return at the opposite ends of said groover valance, each said return slat having said plurality of one of said hooks and loops along an outer face thereof, said fabric being applied to said return slats with the plurality of the one of the hooks and loops engaging the sets of the plurality of said another of said hooks and loops to secure the groover valance to the return slats.

4. A valance assembly according to claim 1 wherein said slats lie next-adjacent one another overlying substantially the entire outer face of said groover valance with said plurality of said another of the hooks and loops forming a substantially continuous outer fastening surface along the outer faces of said slats.

5. A valance assembly according to claim 1 wherein said fabric has longitudinally spaced sets of said plurality of said another of said hooks and loops spaced one from the other along the backside of the fabric, a drawstring disposed along said fabric for shirring down the fabric into a substantially pleated configuration with the sets of said plurality of said another of said hooks and loops exposed along the backside of the fabrics.

6. A valance assembly according to claim 1 wherein said slats are about 5 inches in length.

7. Packaging for top treatment for vertical blinds comprising:

an elongated strip of fabric for forming a valance, said fabric having longitudinally spaced sets of a plurality of one of hooks and loops spaced from one another along the backside of the fabric and a drawstring disposed therealong for shirring the fabric into a substantially pleated configuration with said sets of said plurality of one of said hooks and loops exposed along the backside thereof, said fabric being folded about multiple fold lines generally laterally of its length;

a plurality of slats for insertion along a groover valance, each of said slats having a plurality of another of said hooks and loops along a face thereof for engagement with the set of said plurality of one of said hooks and loops, said slats being superposed one adjacent another; and an enclosure forming a package for receiving the folded fabric and said slats.

* * * * *